US010863808B2

(12) United States Patent
Floyd-Vester et al.

(10) Patent No.: US 10,863,808 B2
(45) Date of Patent: Dec. 15, 2020

(54) CARRY CONTAINER THAT CONVERTS INTO A PROTECTIVE MAT

(71) Applicants: Rita Floyd-Vester, Coral Springs, FL (US); Csaba Vester, Coral Springs, FL (US)

(72) Inventors: Rita Floyd-Vester, Coral Springs, FL (US); Csaba Vester, Coral Springs, FL (US)

(73) Assignee: VECHER HOLDINGS INTERNATIONAL INC., Vancouver (CA)

( * ) Notice: Subject to any disclaimer, the term of this patent is extended or adjusted under 35 U.S.C. 154(b) by 0 days.

(21) Appl. No.: 14/256,980

(22) Filed: Apr. 20, 2014

(65) Prior Publication Data

US 2014/0224701 A1 Aug. 14, 2014

Related U.S. Application Data

(63) Continuation-in-part of application No. 13/904,708, filed on May 29, 2013, now abandoned.

(Continued)

(51) Int. Cl.

*A45C 11/20* (2006.01)
*A45C 7/00* (2006.01)

(Continued)

(52) U.S. Cl.

CPC ..... *A45C 11/20* (2013.01); *A45C 7/00* (2013.01); *A45C 9/00* (2013.01); *A45C 13/103* (2013.01);

(Continued)

(58) Field of Classification Search

CPC ... A45C 11/20; A45C 7/00; A45C 2007/0004; A45C 13/103; A45C 7/0036; A45C 7/0054; A45C 2007/0009; A45C 2007/0013; A45C 9/00; A47G 9/062; A47D 15/003; A45F 4/06

(Continued)

(56) References Cited

U.S. PATENT DOCUMENTS 3,073,367 A * 1/1963 Samara ..... 383/97
3,976,113 A * 8/1976 Kim ..... A45C 9/00 190/2

(Continued)

*Primary Examiner* — Jes F Pascua
*Assistant Examiner* — Matthew T Theis
(74) *Attorney, Agent, or Firm* — McAndrews, Held & Malloy, Ltd.

(57) ABSTRACT

A carry container is interchangeable between a closed position and an open position, wherein the container converts into a protective mat, such as a placemat, and becomes a barrier against germs. In one embodiment, the carry container includes an outer shell including a bottom panel and four side panels extending from the bottom panel and being configured to releasably attach to each of the two neighboring side panels using a fastener to form a container for carrying one or more items, such as food items. An inner lining formed by a generally square sheet is attached to an inner facing side of the outer shell and defines the protective mat when the outer shell is in an open position and flat on a surface. The container can be easily converted between the closed position (lunch box) and open position (protective mat).

17 Claims, 7 Drawing Sheets

Related U.S. Application Data

(60) Provisional application No. 61/652,418, filed on May 29, 2012.

(51) Int. Cl.
*A45C 9/00* (2006.01)
*A45C 13/10* (2006.01)
*A45F 4/06* (2006.01)

(52) U.S. Cl.
CPC ..... *A45C 2007/0004* (2013.01); *A45F 4/06* (2013.01)

(58) Field of Classification Search
USPC ..... 383/4, 10, 120; 206/546; 5/417
See application file for complete search history.

(56) References Cited

U.S. PATENT DOCUMENTS

| | | | | |
|---|---|---|---|---|
| 6,193,034 | B1 * | 2/2001 | Fournier | A45C 7/0095 190/107 |
| 7,597,209 | B2 | 10/2009 | Rothschild et al. | |
| 7,845,508 | B2 | 12/2010 | Rothschild et al. | |
| 8,714,389 | B2 | 5/2014 | Rothschild et al. | |
| 2003/0190096 | A1 * | 10/2003 | Miodragovic et al. | 383/4 |
| 2005/0259894 | A1 * | 11/2005 | Swartz et al. | 383/38 |
| 2006/0169691 | A1 * | 8/2006 | Rothschild | A45C 7/0036 220/7 |
| 2010/0133141 | A1 | 6/2010 | Lebel et al. | |
| 2010/0236953 | A1 | 9/2010 | Myers et al. | |

* cited by examiner

CARRY CONTAINER THAT CONVERTS INTO A PROTECTIVE MAT

This application is a continuation-in-part of U.S. application Ser. No. 13/904,708, filed May 29, 2013 which claims the benefit of and priority to U.S. Provisional Patent Application Ser. No. 61/652,418, filed May 29, 2012. Both applications are incorporated by reference in their entirety.

FIELD OF THE INVENTION

The present invention relates to food carrying containers and, more particularly, to a carry container that converts into a placemat for forming a barrier between the surface upon which the container is resting and the user while eating.

BACKGROUND

Studies have shown that the most prevalent area for germs in a school setting is the cafeteria table. Some bacteria are capable of causing infections and tend to collect on frequently touched surfaces, particularly in areas where there is a lot of hand-to-mouth contact like the cafeteria table. When children touch the contaminated surface, the germs are transmitted to their hands, and if they subsequently touch their eyes, nose or lips, it is likely that they have infected themselves. The best way to avoid the spreading of germs is to never touch infected surfaces.

Lunch boxes have long been known and widely used by children all over the world. The majority of lunch boxes used today are not washable and, therefore, cannot be properly sanitized. The combination of the unclean lunch boxes and germ-infested cafeteria tables provides an ideal scenario for spreading germs.

Therefore, there is a particular need to overcome the problems discussed above by reducing the amount of germs a child comes into contact with while having a meal away from home, such as, but not limited to, having lunch at a school cafeteria table. The disclosed embodiments are directed to the above-noted problems. However, the disclosed embodiment is neither limited to use by children, nor is limited to use as a placemat in a school cafeteria.

SUMMARY

The disclosed embodiment directed to a carry container that is interchangeable between a closed position and an open position, wherein the container (closed position) opens into a protective mat or surface (open position), such as, but not limited to, a placemat, and becomes a barrier against germs. In one embodiment, the container includes an outer shell including a bottom panel and four side panels extending from the bottom panel and being configured to releasably attach to each of the two neighboring side panels using a fastener. The container can be easily convened between the closed position (lunch box, container, etc.) and open position (placemat, protective surface, etc.).

Thus, the disclosed embodiment provides a container that converts into a protective mat for limiting exposure of the user to germs. The container/protective mat can be preferably machine washable. In one preferred use of the disclosed embodiment, the washable container converts into a protective mat is easily converted between a closed position for carrying or storing food items and an open position for eating the food items, as well as other food items that may be in the user's possession.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF PREFERRED EMBODIMENT

Referring to the several views of the drawings, the washable container that converts into a protective mat is shown and is generally indicated as 10.

Figure 1:
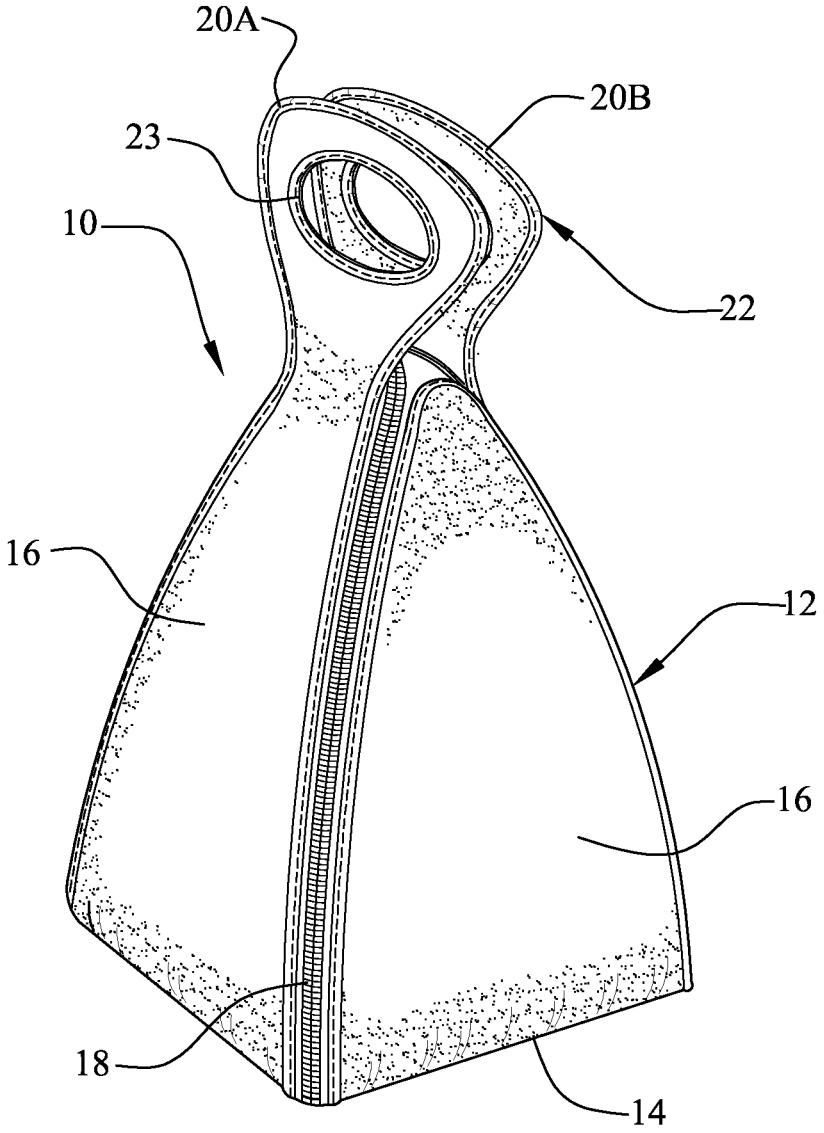
FIG. 1 is a perspective view illustrating the food carrying container in a closed position, which is capable of converting into a protective mat in an opened position.
Figure 2:
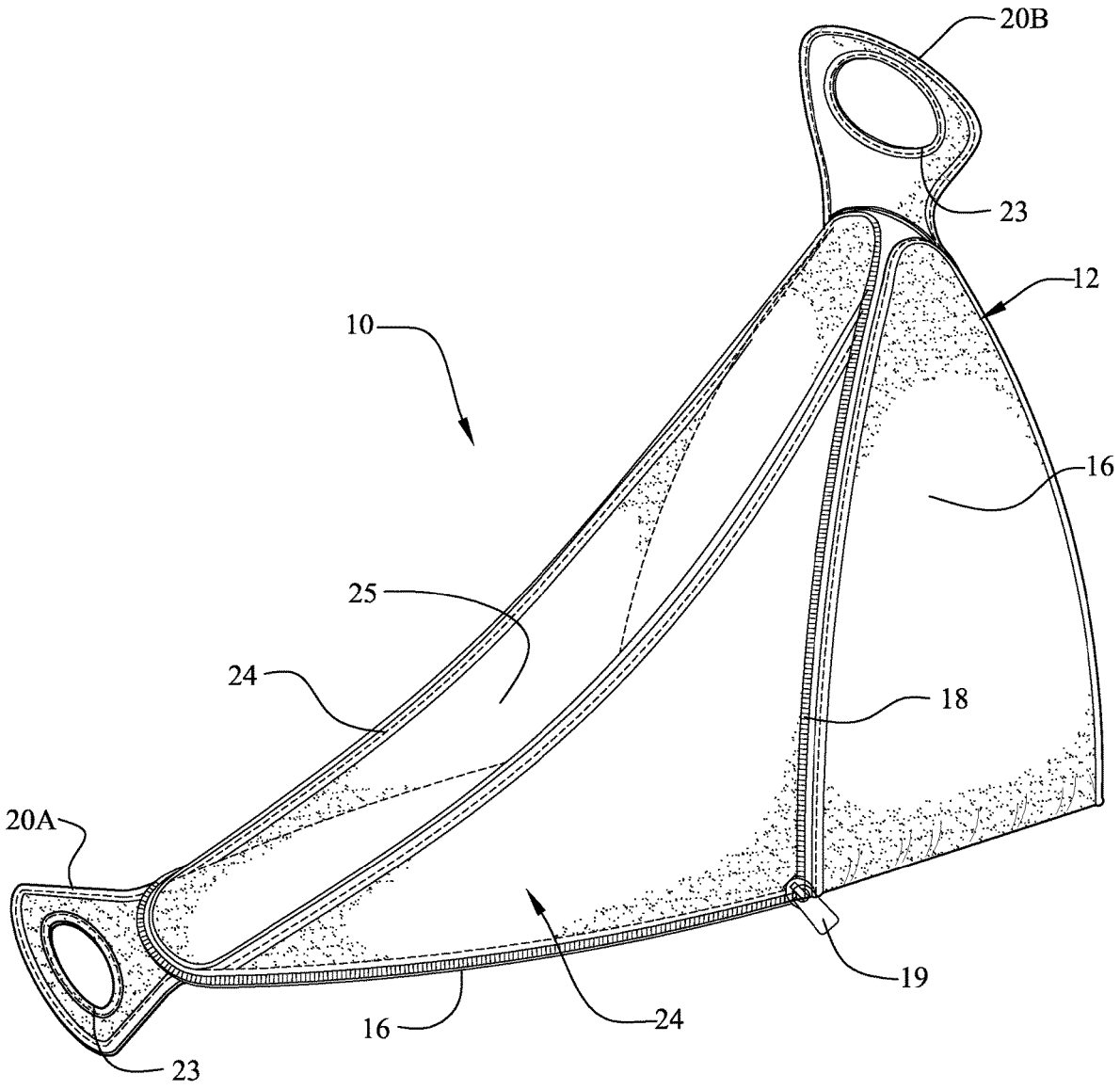
FIG. 2 is a perspective view illustrating the food carrying container of FIG. 1 in a partially opened position, wherein one side panel is open, thus providing access to any contents (not shown) being stored within the container.

Referring initially to FIGS. 1 and 2, the convertible, and washable container 10 includes a shell or outer shell 12 (outer in the closed position/configuration) including an integrally formed bottom panel 14 and side panels 16. Bottom panel 14 and side panels 16 can be monolithically formed as a one-piece member, can be constructed from a single piece of material, can be separate pieces of materials that can be preferably permanently secured together, such as, but not limited to by stitching, sewing, welding, etc.

A plurality of fasteners 18 on each of the side panels 16 are configured to secure the panels 16 together. In a preferred embodiment, the fasteners 18 are zipper fasteners and include zipper pull tabs 19 for manually fastening and unfastening the side panels 16, as shown in the drawings. Other embodiments of the fasteners 16 include hook and loop fasteners, clips, or any other suitable closure mechanisms.

The washable food carrying container 10 is interchangeable between a closed position and an open position. The closed position, wherein the fasteners 18 are securing, the side panels 16 together, represents a container having an interior cavity suitable for storing food items and other items. In a preferred embodiment, the side panels 16 and fasteners 18 are configured such that the container 10 is substantially dome or pyramid-shaped when in the closed position. In one embodiment, handle members 20A and 20B are included on opposite facing side panels 16 for forming a handle 22 when the container 10 is in the closed position. Each handle member 20A and 20B may include a handle opening 23 sized for receiving a portion of a user's hand. Alternatively, the handle 22 and opening 23 may be formed as extensions of opposing side panels 16 (FIG. 5) or can be secured to opposing side panels 16 (FIG. 3) such as, but not limited to, by stitching, discussed in more detail in the next paragraph.

Figure 3:
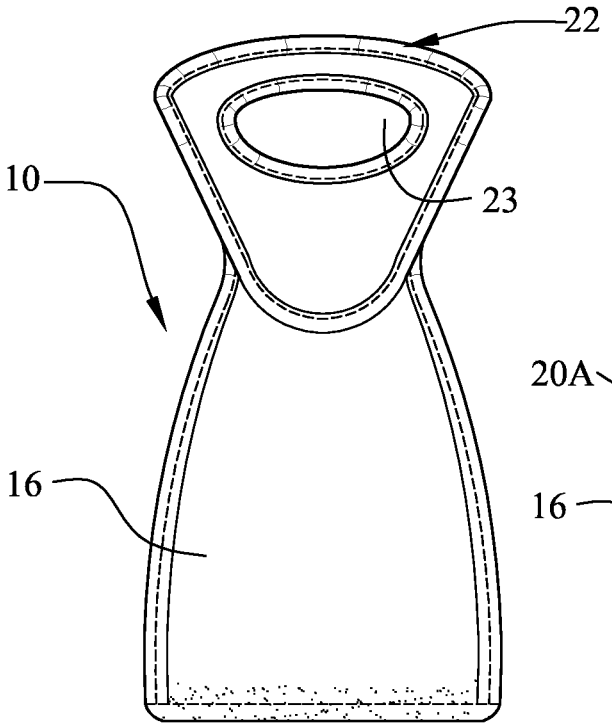
FIG. 3 is a side view illustrating the food carrying container of FIG. 1 in the closed position.
Figure 4:
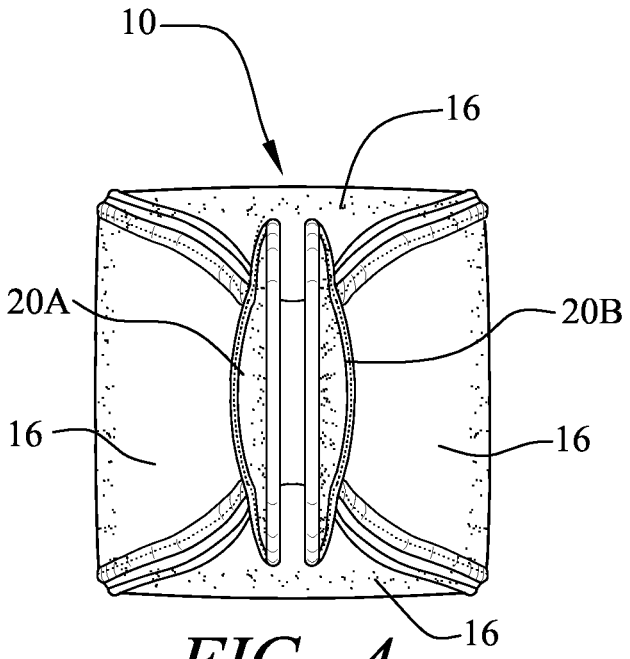
FIG. 4 is a top view illustrating the food carrying container of FIG. 1 in the closed position.
Figure 5:
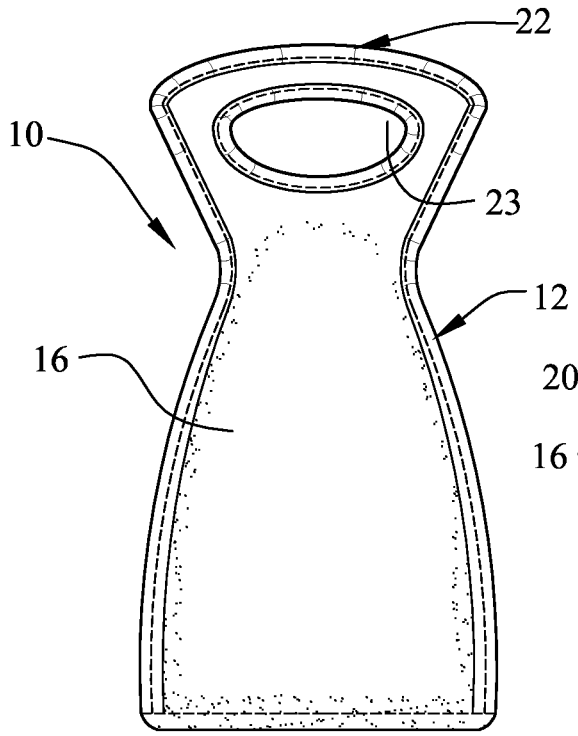
FIG. 5 is a front side view illustrating the food carrying container of FIG. 1 in the closed position.
Figure 6:
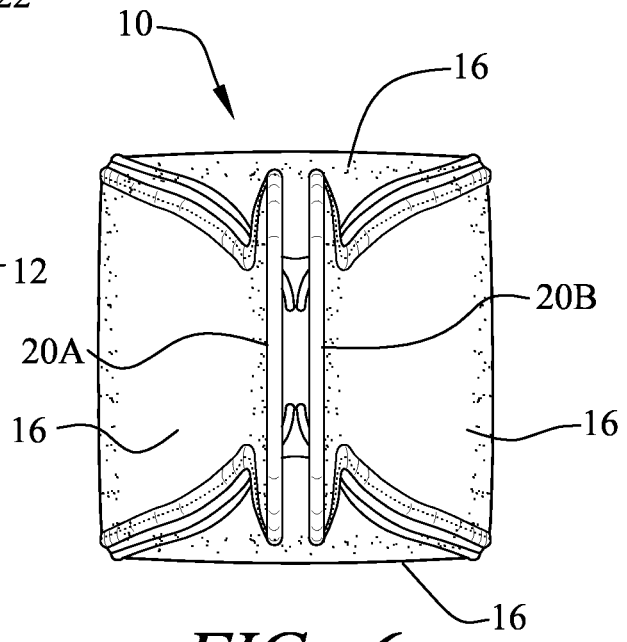
FIG. 6 is a top view illustrating the food carrying container of FIG. 1 in the closed position.

Referring to FIGS. 3-6, two different embodiments of the food container 10 are shown. FIGS. 3 and 4 illustrate a first embodiment of the handle 22, wherein handle members 20A and 20B are sewn onto opposite facing side panels 16. FIGS. 5 and 6 illustrate an alternative embodiment of the handle 22, wherein handle members 20A and 20B are formed as pan of the outer shell 12 at opposite facing side panels 16.

Figure 7:
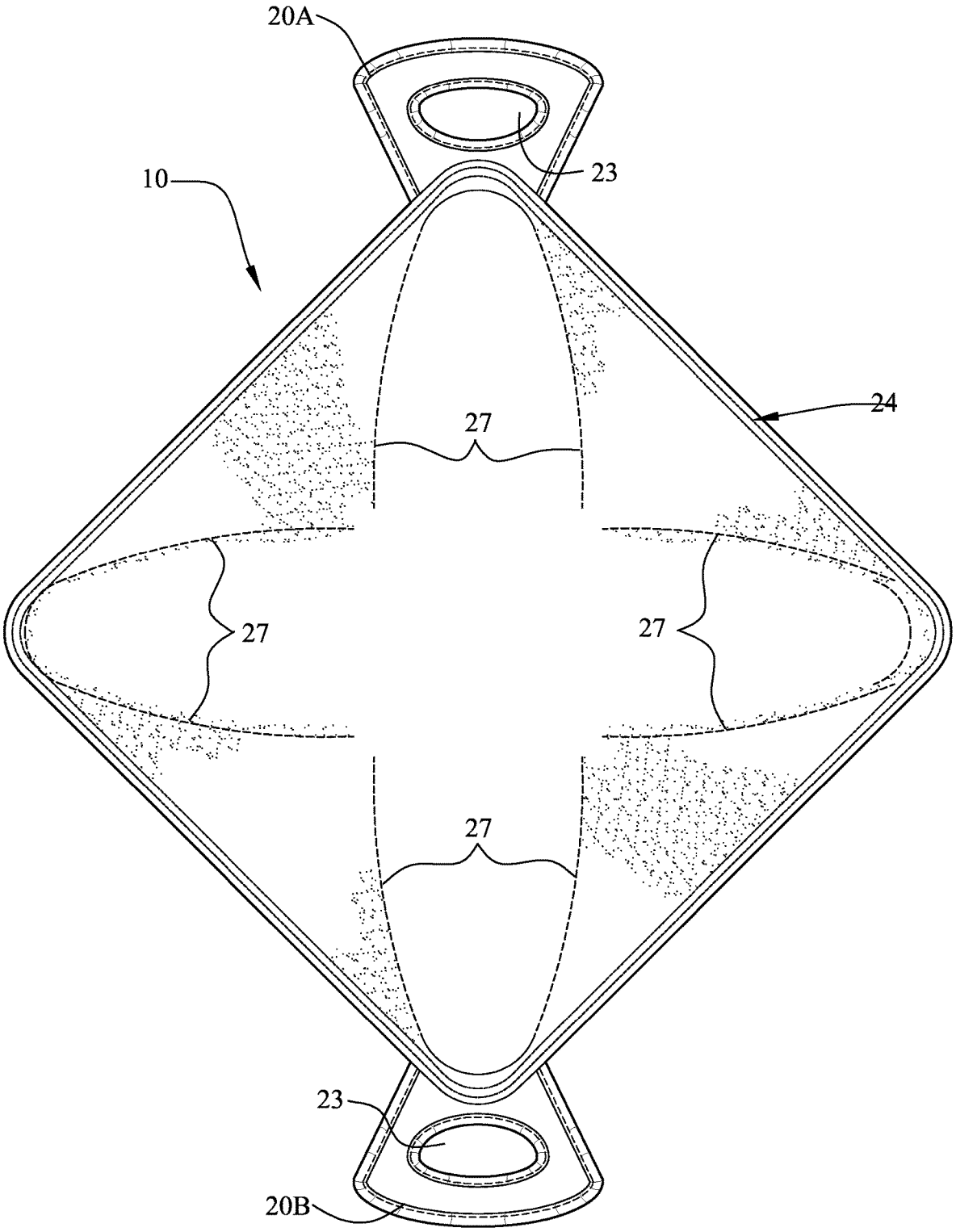
FIG. 7 is a top view illustrating the food carrying container that converts into a protective mat according to one embodiment in the open position.
Figure 8:
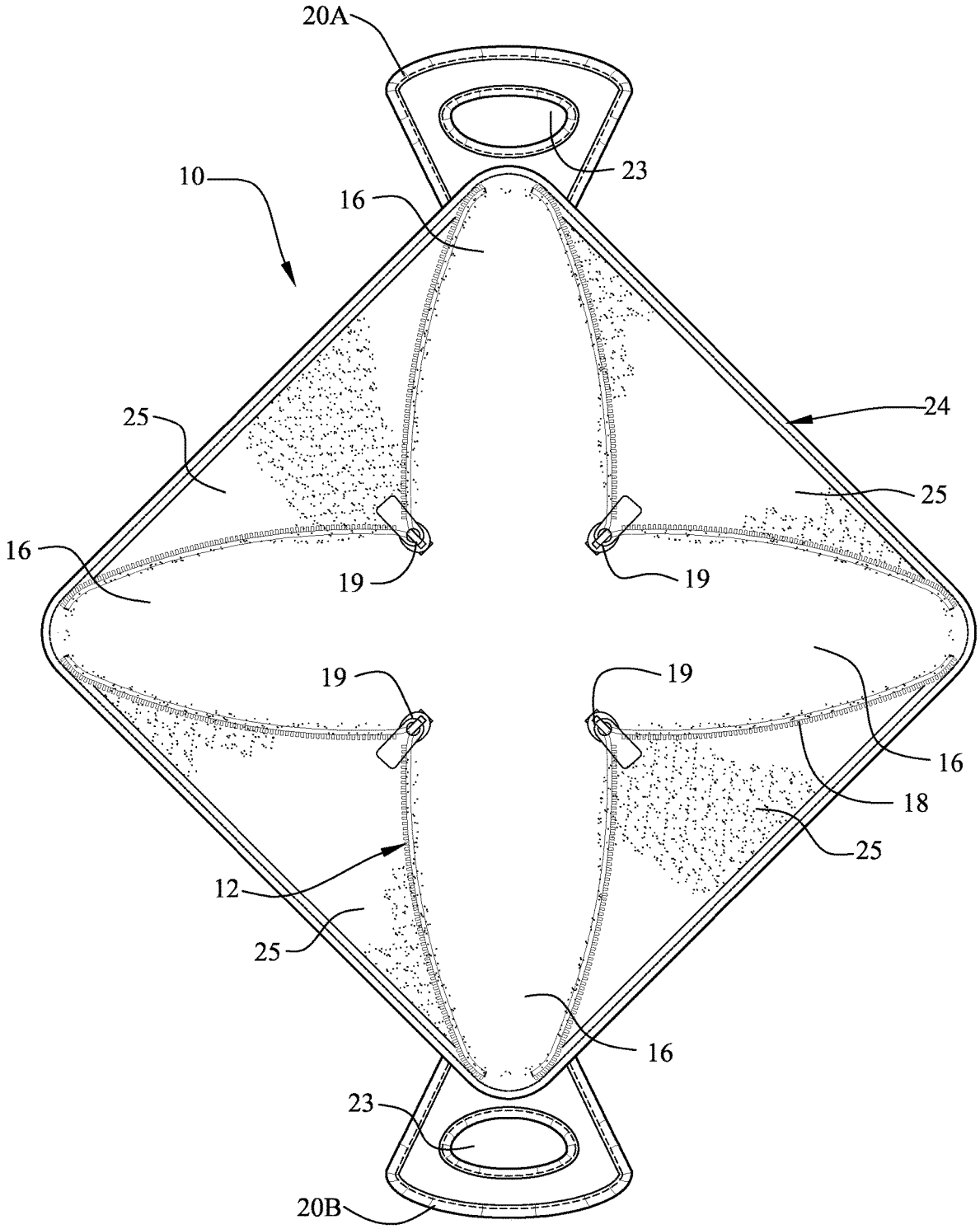
FIG. 8 is a bottom view illustrating the food carrying container that converts into a protective mat of FIG. 7 in the open position.
Figure 9:
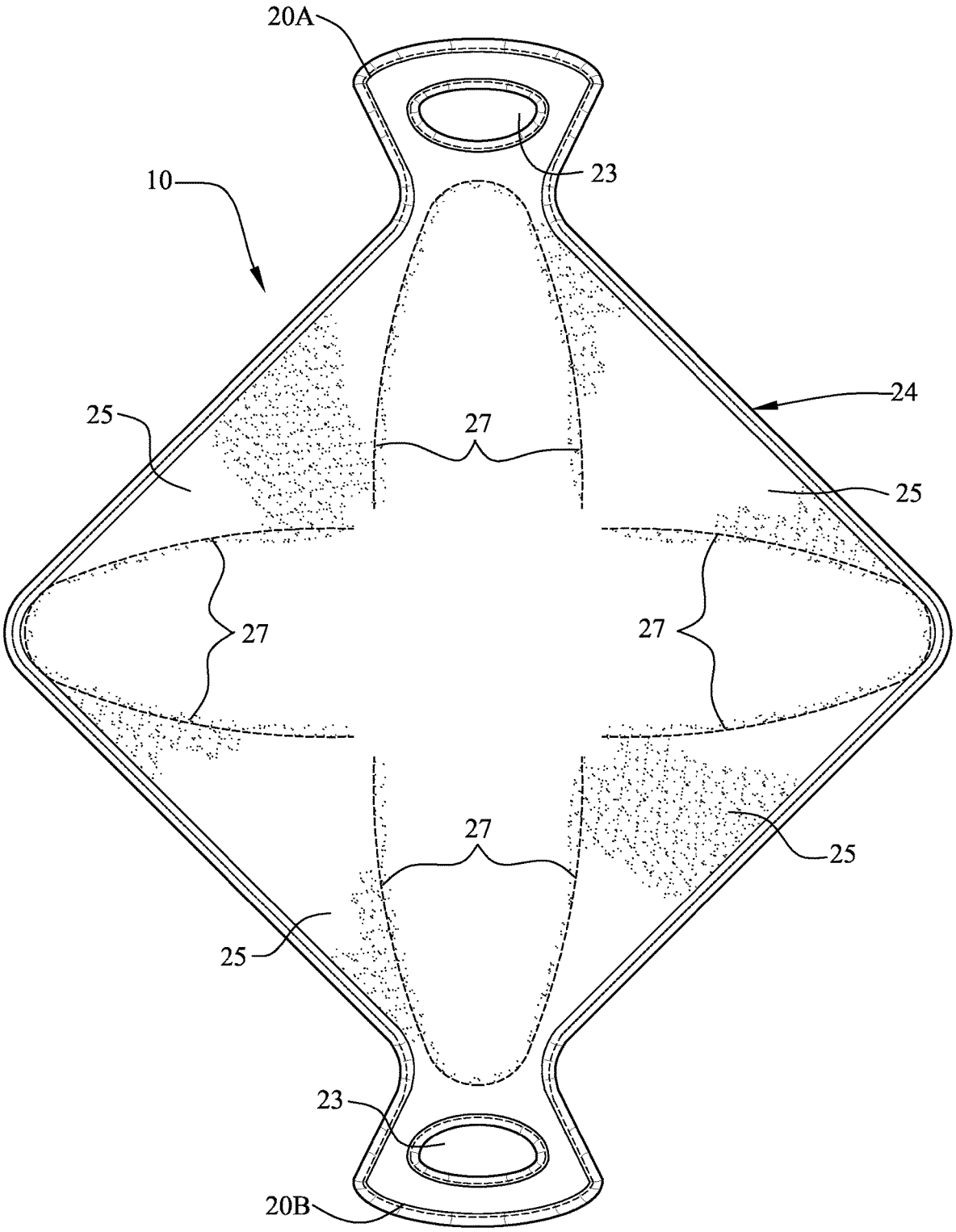
FIG. 9 is a top view illustrating the food carrying container that converts into a protective mat according to another embodiment in the open position.

Referring to FIGS. 7-10, the container 10 is shown in the open position, wherein the fasteners 18 are undone and the side panels 16 are separated from each other. The open position represents a protective mat configuration for forming a barrier between the surface upon which the container 10 is resting and the user. An inner lining 24 serves as the protective mat, such as a placemat, when the container 10 is in the open position. The inner lining 24 is attached to the inner facing side of the outer shell 12. When inner lining 24 is secured to outer shell, portions of of inner lining 24 form webbing that covers over the space defined between adjacent side panels 16 in the open configuration. Inner lining 24 forms the continuous eating surface by itself. Side panels 16 play no role in forming the continuous eating surface as they are all disposed underneath inner lining 24 in the open position/configuration. In one embodiment, the inner lining 24 is attached to the inner facing side of the outer shell by stitching 27, as shown in FIGS. 7 and 9. Other suitable means of attaching the inner lining to the outer shell may be used as well.

Figure 10:
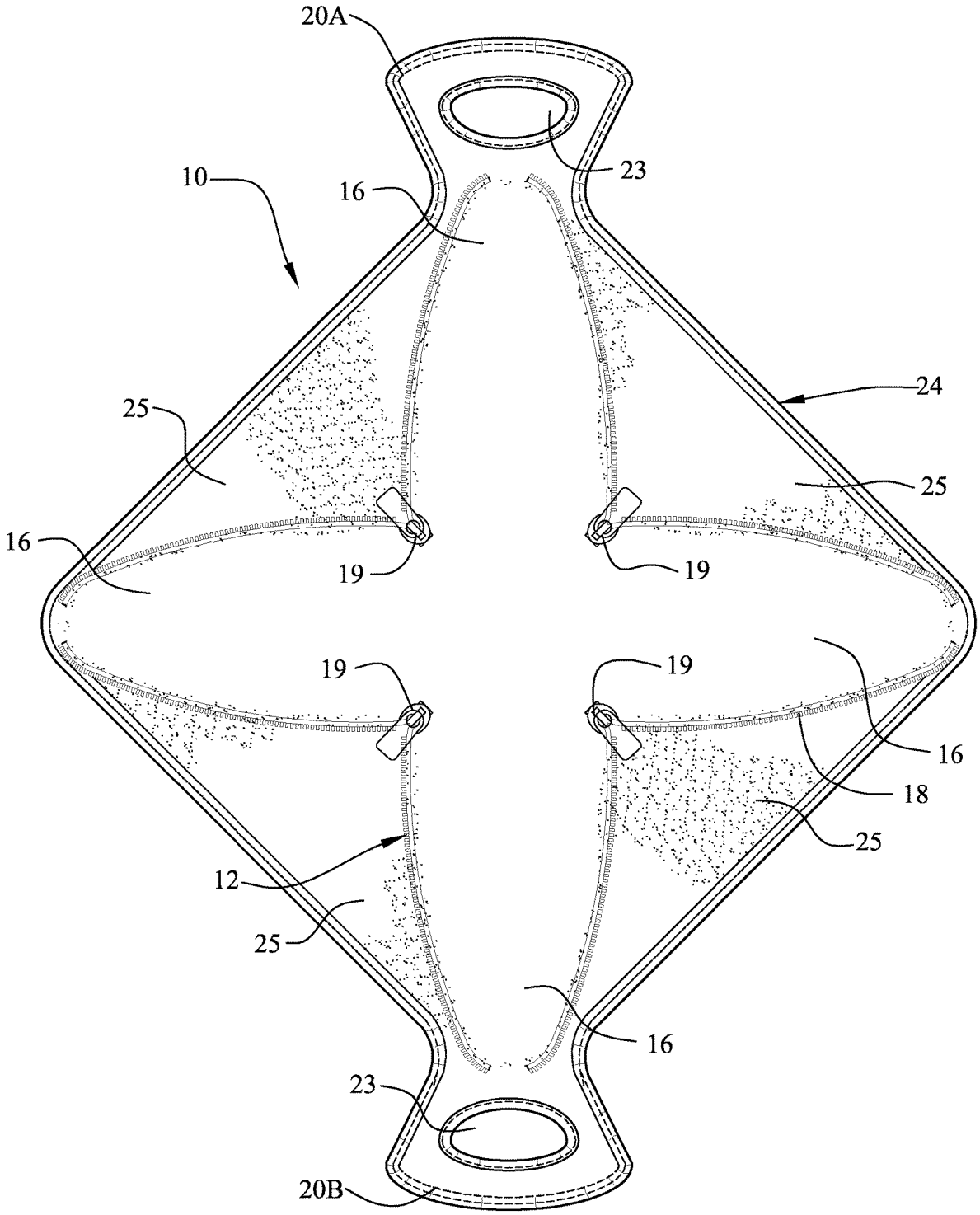
FIG. 10 is a bottom view illustrating the food carrying container that converts into a protective mat of FIG. 9 in the open position.

The open position, with inner lining 24 providing a continuous eating surface, decreases the likelihood that a user's hands or food items will come into contact with the table surface, thereby reducing the spread of bacteria, viruses and fungi. FIGS. 7 and 8 illustrate the embodiment of the container 10 shown in FIGS. 3 and 4, wherein the handle members 20A and 20B are sewn onto opposite facing side panels 16. FIGS. 9 and 10 illustrate the embodiment of the container 10 shown in FIGS. 5 and 6, wherein the handle members 20A and 20B are formed as part of the outer shell 12 at opposite facing side panels 16.

In order to store foods items in the container 10, it is preferable for the container 10 to be partially opened, such that the fasteners 18 are partially separated to allow the upper portions of the side panels 16 to be separated for easy loading of the container 10. Alternatively, the container 10 could be loaded in the open position (i.e. protective mat configuration) and then fastened or, alternatively, with one or two side panels 16 in the open position. As a further alternative, some, but not all, of fasteners 18 can be undone to provide access to internal area of container 10 (See FIG. 2).

In a preferred embodiment, the outer shell 12, inner lining 24 and fasteners 18 can each be made from a machine washable material. In one embodiment, the outer shell 12 can preferably be made from a heat resistant material, such as neoprene fabric. The outer shell 12 may be made from one layer of material. Other embodiments of the outer shell 12 include multiple layers of different materials having varying thicknesses. For example, the outer shell 12 can be made from a heat resistant material and inner lining 24 (i.e. continuous eating surface) of the container 10 can be made from a washable nylon or neoprene fabric. The different layers of materials may be attached together by conventional methods, such as, but not limited to, one or more of the following: adhesives, sewing, stitching, welding, glues, and tapes.

A tab (preferably a fabric tab) can be disposed at the base of each zipper assembly (i.e. at or near the bottom corner in the closed figuration), which can be grabbed by the user and makes moving the associated zipper up and down easier. In one non-limiting embodiment the tab can be in the form of loop secured at or near the bottom corner in the closed figuration. Additionally, each zipper assembly can be provided with an grab extension (i.e. preferably made from rubber) that is secured to the normal grabbing portion of the zipper to make the grabbing area larger and thus, easier to hold onto when moving the zipper up and down. In one non-limiting embodiment, the grab extension can be substantially rectangularly in shape and can have its outer end somewhat dome shaped.

Thus, the disclosed embodiments show a carry container that is convertible into a protective mat, and the carry container can comprise:

an outer shell including a bottom panel and a plurality of side panels extending from the bottom panel and terminating at an apex, the adjacent panels of the plurality of side panels defining a space therebetween;

an inner lining formed by a generally square sheet attached to an inner facing side of said outer shell so that each corner of the inner lining aligns with the apex of a correspondingly positioned one of the plurality of side panels, the inner lining defining a plurality of web portions, each of the web portions located adjacent to a corresponding space defined by adjacent panels of the plurality of side panels, the inner lining providing a protective mat having a continuous outer flat or substantially flat surface when the outer shell is in an open position with the plurality of side panels and the bottom panel disposed underneath of the inner lining in the open position; and at least one fastener on each of the plurality of side panels structured and disposed for releasably securing each of the plurality of side panels to each neighboring or adjacent side panel so that that outer shell is converted into a closed position, and the bottom panel and plurality of side panels defining an interior cavity or area for enclosing or storing one or more items in the outer shell.

The bottom panel and plurality of side panels can form a substantially dome or pyramid shaped configuration in the closed position. The carry container can further comprise a handle. In one embodiment, the handle comprises a first handle member extending substantially upward from a first of the plurality of side panels in the closed position and a second handle member extending, substantially upward from a second of the plurality of side panels in the closed position. The first side panel and the second side panel positioned opposite of each other. The first and second handle members being sized and configured to be adjacently positioned when the outer shell is in the closed position such that a user can grasp both the first and second handle member with one hand.

The fastener can be a zipper fastener, a hook and loop fastener, a magnetic fastener, a dip fastener, etc. The outer shell can be made from a heat resistant material, a neoprene fabric, a nylon, etc. The outer shell, inner lining and at least one fastener can be machine washable.

Although the present invention has been shown and described as being suitable for carrying food items, it is not limited to such, and may be used to can other objects at the discretion of the user.

All measurements, dimensions, amounts, sizes, shapes, percentages, configurations, securement or attachment mechanisms, numbers, ranges, values, percentages, materials, orientations, methods of manufacture, etc. discussed above or shown in the drawing figures are merely by way of example and are not considered limiting and other measurements, dimensions, amounts, sizes, shapes, percentages, configurations, securement or attachment mechanisms, numbers, ranges, values, percentages, materials, orientations, methods of manufacture, etc. can be chosen and used and all are considered within the scope of the invention. Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed, and such feature(s), pan(s), components(s), characteristic(s) or function(s) should not be read into the claim, claim element, claim step or claim term. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to or described with the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

While the present invention has been shown and described in accordance with several preferred and practical embodiments thereof, it is recognized that departures from the instant disclosure are fully contemplated within the spirit and scope of the invention.

What is claimed is:

1. A carry container that is convertible into a protective mat, and said carry container comprising:

a shell including a four-sided bottom panel and four similarly shaped and similarly sized side panels extending from the bottom panel, wherein in an open position adjacent panels of the four side panels defining a substantially inverted triangular shaped opening between the two adjacent panels extending from the bottom panel to the outer ends of the adjacent panels, the substantially inverted triangular shaped opening having a tip portion disposed adjacent to the bottom panel, in an open position an outer perimeter of the four side panels collectively form a non-square and non-triangular shaped pattern, each of the plurality of side panels having two curved side edges and an outer single point apex, each of the curved side edges for each side panel beginning at the bottom panel and terminating at the outer single point apex of the side panel to form a rounded outer top edge for the side panel;

a preformed four-sided and four corner lining constituting a separate component from the shell and attached to an inner facing side of said shell, said lining have a different shape from the shape of said shell, said lining having a plurality of web portions, wherein in an open and in use position where said inner lining is positioned above said shell said lining providing a protective mat having a continuous upper substantially flat surface with the four side panels and said bottom panel of the shell fully disposed underneath of said lining, wherein in an open position the outer apex of each side panel is disposed at a corresponding one of the corners of the four corners of the lining, each of said web portions is only viewable through a corresponding one substantially inverted triangular shaped opening when said container in an open position and when said lining is in an unfolded configuration and positioned underneath said shell; wherein in the open position a first outer perimeter of the lining extending approximately to a second outer perimeter defined by the four similarly shaped and similarly sized panels and the substantially inverted triangle shaped openings between the panels; and a plurality of zipper fasteners for securing adjacent side panels together in a closed position, each of said zipper fasteners comprising a first strip of zipper teeth disposed along a side edge of a first panel of the adjacent panels, a second strip of zipper teeth disposed along a side edge of a second panel of the adjacent panels and a zipper slide secured to both the first strip of zipper teeth and the second strip of zipper teeth in a fully open position through a fully closed position;

wherein each zipper fastener of said plurality of zipper fasteners releasably securing a side panel to a neighboring side panel so that said shell is converted into a substantially dome or pyramid shaped enclosure in a closed position in view of the curved shaped side edges of each side panel and with the bottom panel and the four side panels defining an interior cavity for enclosing an item in said shell;

wherein in a closed and upright position the zipper slide for each of the zipper fasteners are located near a top area of the container and are adjacent to each other;

wherein in a fully closed position the rounded top edges of all of the side panels are adjacent to each other; wherein in the fully closed position all of the side panels are positioned upwardly from the bottom panel and the side panels are angled inwardly to that the rounded top edges of the four side panels are adjacent to each other and causing the four side panels to form a substantially closed upper top portion for the substantially dome or pyramid shaped enclosure;

wherein in a shell fully opened and flat position and prior to attaching the separate lining to the shell adjacent panels of the four side panels each define an unobstructed substantially inverted triangular shaped opening between the two adjacent panels extending from the bottom panel to the outer ends of the adjacent panels.

2. The carry container of claim 1 further comprising a handle.

3. The carry container of claim 2 wherein said handle comprises a first handle member extending substantially upward from an upper top portion of a first of the four side panels in the closed position and a second handle member extending substantially upward from an upper top portion of a second of the four side panels in the closed position, said first side panel and said second side panel positioned opposite of each other, said first and second handle members being sized and configured to be adjacently positioned when said shell is in the closed position such that a user can grasp both said first handle member and said second handle member with one hand.

4. The carry container of claim 1 wherein said outer shell is made from a heat resistant material.

5. The carry container of claim 1 wherein said outer shell is made from neoprene fabric.

6. The carry container of claim 1 wherein said lining is made from neoprene fabric.

7. The carry container of claim 1 wherein said lining is made from nylon fabric.

8. The carry container of claim 1 wherein said outer shell, lining and at least one fastener are machine washable.

9. The carry container of claim 1 wherein each of the plurality of side panels having two curved side edges beginning at the bottom panel and terminating into the single point apex of the rounded top edge.

10. A carry container that is convertible into a protective mat, and said carry container comprising:

a shell including a four-sided bottom panel and four similarly shaped and similarly sized side panels extending from the bottom panel, wherein in an open position adjacent panels of the four side panels defining a substantially inverted triangular shaped opening between the two adjacent panels extending from the bottom panel to the outer ends of the adjacent panels, the substantially inverted triangular shaped opening having a tip portion disposed adjacent to the bottom panel, in an open position an outer perimeter of the four side panels collectively form a non-square and non-triangular shaped pattern, each of the plurality of side panels having two curved side edges and an outer single point apex, each of the curved side edges for each side panel beginning at the bottom panel and terminating at the outer single point apex of the side panel to form a rounded outer top edge for the side panel;

a preformed four-sided and four corner lining constituting a separate component from the shell and attached to an inner facing side of the shell, the lining have a different shape from the shape of said shell, said lining having a plurality of web portions, wherein in an open and in use position where said inner lining is positioned above said shell said lining providing a protective mat having a continuous upper substantially flat surface with the four side panels and said bottom panel of the shell fully disposed underneath of said lining, wherein in an open position the outer apex of each side panel is disposed at a corresponding one of the corners of the four corners of the lining, each of said web portions is only viewable through a corresponding one substantially inverted triangular shaped opening when said container in an open position and when said lining is in an unfolded configuration and positioned underneath said shell; wherein in the open position a first outer perimeter of the lining extending approximately to a second outer perimeter defined by the four similarly shaped and similarly sized panels and the substantially inverted triangle shaped openings between the panels; and a plurality of zipper fasteners for securing adjacent side panels together in a closed position, each of said zipper fasteners comprising a first strip of zipper teeth disposed along a side edge of a first panel of the adjacent panels, a second strip of zipper teeth disposed along a side edge of a second panel of the adjacent panels and a zipper slide secured to both the first strip of zipper teeth and the second strip of zipper teeth in a fully open position through a fully closed position; wherein in a fully open position a first end of the first strip of zipper teeth and a first end of the second strip of zipper teeth are positioned at an approximately 90 degree angle with respect to each other;

wherein each zipper fastener of said plurality of zipper fasteners releasably securing a side panel to a neighboring side panel so that the shell is converted into a substantially dome or pyramid shaped enclosure in a closed position in view of the curved shaped side edges of each side panel and with the bottom panel and the four side panels defining an interior cavity for enclosing an item in the shell;

wherein in a fully closed position the rounded top edges of all of the side panels are adjacent to each other; wherein in the fully closed position all of the side panels are positioned upwardly from the bottom panel and the side panels are angled inwardly to that the rounded top edges of the four side panels are adjacent to each other and causing the four side panels to form a substantially closed upper top portion for the substantially dome or pyramid shaped enclosure wherein in an open position an apex of each side panel is disposed at a corresponding one of the corners of the four corners of the lining;

wherein in a shell fully opened and flat position and prior to attaching the separate lining to the shell adjacent panels of the four side panels each define an unobstructed substantially inverted triangular shaped opening between the two adjacent panels extending from the bottom panel to the outer ends of the adjacent panels.

11. The carry container of claim 10 further comprising a handle.

12. The carry container of claim 11 wherein said handle comprises a first handle member extending substantially upward from an upper top portion of a first of said plurality of side panels in the closed position and a second handle member extending substantially upward from an upper top portion of a second of said plurality of side panels in the closed position, said first side panel and said second side panel positioned opposite of each other, said first and second handle members being sized and configured to be adjacently positioned when said shell is in the closed position such that a user can grasp both said first handle member and said second handle member with one hand.

13. A carry container that is convertible into a protective mat, and said carry container comprising:

a shell including a four-sided bottom panel and four similarly shaped and similarly sized side panels extending from the bottom panel, each of the side panels of the four side panels having an outer end defining an apex; wherein in an open position adjacent panels of the four side panels defining a substantially inverted triangular shaped opening between the two adjacent panels extending from the bottom panel to the outer ends of the adjacent panels, the substantially inverted triangular shaped opening having a tip portion disposed adjacent to the bottom panel, in an open position an outer perimeter of the four side panels collectively form a non-square and non-triangular shaped pattern, each of the plurality of side panels having two curved side edges and an outer single point apex, each of the curved side edges for each side panel beginning at the bottom panel and terminating at the outer single point apex of the side panel to form a rounded outer top edge for the side panel;

a preformed four-sided and four corner lining constituting a separate component from the shell and attached to an inner facing side of the shell, said lining having four corners and a different shape from the shape of the shell, the lining defining a plurality of web portions, wherein in an open and in use position where said inner lining is positioned above said shell said lining providing a protective mat having a continuous upper substantially flat surface with the four side panels and said bottom panel of the shell fully disposed underneath of said lining, each of said web portions is only viewable through a corresponding one substantially inverted triangular shaped opening when said container in an open position and when said lining is in an unfolded configuration and positioned underneath said shell; wherein in the open position a first outer perimeter of the lining extending approximately to a second outer perimeter defined by the four similarly shaped and similarly sized panels and the substantially inverted triangle shaped openings between the panels; and wherein in an open position the apex of each side panel is disposed at a corresponding one of the corners of the four corners of the lining;

a plurality of zipper fasteners for securing adjacent side panels together in a closed position, each of said zipper fasteners comprising a first strip of zipper teeth disposed along a side edge of a first panel of the adjacent panels, a second strip of zipper teeth disposed along a side edge of a second panel of the adjacent panels and a zipper slide secured to both the first strip of zipper teeth and the second strip of zipper teeth in a fully open position through a fully closed position;

wherein each zipper fastener of said plurality of zipper fasteners releasably securing a side panel to a neighboring side panel so that the shell is converted into a substantially dome or pyramid shaped enclosure in a closed position in view of the curved shaped side edges of each side panel and with the bottom panel and the four side panels defining an interior cavity for enclosing an item in the shell;

wherein in a fully closed position the rounded top edges of all of the side panels are adjacent to each other; wherein in the fully closed position all of the side panels are positioned upwardly from the bottom panel and the side panels are angled inwardly to that the rounded top edges of the four side panels are adjacent to each other and causing the four side panels to form a substantially closed upper top portion for the substantially dome or pyramid shaped enclosure;

wherein in a shell fully opened and flat position and prior to attaching the separate lining to the shell adjacent panels of the four side panels each define an unobstructed substantially inverted triangular shaped opening between the two adjacent panels extending from the bottom panel to the outer ends of the adjacent panels.

14. The carry container of claim 13 wherein said bottom panel and said four side panels are monolithically formed and constructed from a single piece of material and form a one-piece shell.

15. The carry container of claim 13 wherein said four side panels are permanently secured to said bottom panel to form an integral one-piece shell.

16. The carry container of claim 13 further comprising a plurality of tabs, each tab from said plurality of tabs disposed at or near a bottom corner of the outer shell when in a closed configuration and available to a user to hold on to with one hand while moving an associated zipper assembly with an other hand of the user.

17. The container of claim 13 wherein in a fully open position a first end of the first strip of zipper teeth and a first end of the second strip of zipper teeth are positioned at an approximately 90-degree angle with respect to each other.

* * * * *